United States Patent [19]

Williams

[11] Patent Number: 4,823,366

[45] Date of Patent: Apr. 18, 1989

[54] MATERIAL CONVEYING EQUIPMENT WITH CONTROL FOR PAVING MATERIALS USING ULTRASONIC WAVES

[75] Inventor: Loren E. Williams, Olney, Ill.

[73] Assignee: White Consolidated Industries, Inc., Ohio

[21] Appl. No.: 14,991

[22] Filed: Feb. 17, 1987

[51] Int. Cl.[4] ..... E01C 19/48

[52] U.S. Cl. ..... 377/2; 377/16; 377/17; 404/84; 198/502.2; 340/612; 367/99

[58] Field of Search ..... 377/15, 16, 17, 2, 21; 328/2, 5; 404/84; 198/502.1, 502.2; 340/612; 367/99

[56] References Cited

U.S. PATENT DOCUMENTS

| | | | |
|---|---|---|---|
| 3,554,291 | 1/1971 | Rogers | 404/84 |
| 3,594,648 | 7/1971 | Rapraport | 377/2 |
| 3,889,796 | 6/1975 | Bailey et al. | 198/502.1 |
| 3,976,989 | 8/1976 | Smith | 377/2 |
| 4,012,160 | 3/1977 | Parker | 404/84 |
| 4,052,676 | 10/1977 | Crittenden | 377/2 |
| 4,065,856 | 1/1978 | Waters | 404/84 |
| 4,189,133 | 2/1980 | Arrasmith et al. | 377/2 |
| 4,698,634 | 10/1987 | Alongi et al. | 342/22 |
| 4,750,584 | 6/1988 | Tanaka et al. | 367/99 |

*Primary Examiner*—John S. Heyman
*Attorney, Agent, or Firm*—Alfred E. Miller

[57] ABSTRACT

A sensing arrangement for sensing the level of a bulk material, such as the paving material fed by a paving machine, comprises an ultrasonic transducer spaced from the paving material for controlling the feed of material.

20 Claims, 5 Drawing Sheets

MATERIAL CONVEYING EQUIPMENT WITH CONTROL FOR PAVING MATERIALS USING ULTRASONIC WAVES

This invention relates to a feed control arrangement for bulk materials, and is especially directed to arrangements for improving the feeding of rotating materials, such as asphalt or other materials in road pavers, wideners, etc. While the invention will be described with particular reference to such applications, it will be apparent that the concept of the invention, as discussed herein, is not so limited.

In road paving equipment of one type, paving material such as asphalt is fed rearwardly on the equipment, for example by a conveyor chain or the like, as the equipment is moved forwardly along a road or road bed, the paving material being fed to a device for distributing the material transversely, such as an auger in the case of a paving device, or a belt in the case of road widening equipment. The paving material is deposited in front of a screed, which may be a floating screed, to effect the leveling and compaction of the material. Typical paving devices are disclosed, for example, in U.S. Pat. No. 3,584,547, Davin, and typical road wideners are disclosed, for example, in U.S. Pat. No. 3,636,831, Davin et al.

In order to enable the laying of a smooth road surface by such equipment, it is necessary to maintain control over the amount of material deposited along the front of the transverse feed device, such as an auger. The asphalt piled and distributed in front of the screed applies forces to the screed, causing the screed to vary its level in response to the amount of material distributed thereto. It is therefore apparent that variations in the height of the paving material in front of the screed results in variations in the thickness of paving material applied to a road surface and, hence, in reduction of smoothness of the surface.

This problem has been recognized in the past, and a solution thereof is suggested, for example, in U.S. Pat. No. 3,678,817, Martenson et al, wherein paddles are mounted on the paving equipment adjacent each side thereof, the paddles riding on the surface of the asphalt as it is conveyed to the auger. The paddles are coupled to arms of potentiometers, thereby providing signals responsive to the height of the paving material at the paddles, a function of the feed of paving material to the screed. This reference discloses that such signals may be employed to control various feed functions of the equipment, such as the speed of rotation of the auger, the speed of movement of the conveyor device conveying material from a hopper to the auger, or controlling the height of a gate to adjust the permissable thickness of paving material on the conveyor. While paddle controlled potentiometers of this type simplified the automatic control of feed of paving material, to improve the smoothness of the road surface, they have been subject to problems. The paddles, resting directly on the paving material, such as hot asphalt or the like, are subject to buildup of material adhering thereto, thereby resulting in erroneous indications of the actual height of the paving material in front of the screed. On occasion, the paddles may even become buried in the asphalt material, thereby resulting in the production of signals that have no relation to material thickness.

The problem is compounded when screed extensions are employed, for example as disclosed in U.S. Pat. No. 3,702,578, Davin, or when telescoping screeds are employed, for example, as described in U.S. Pat. No. 4,379,653, Brown. It is conventional to provide an end plate at the sides of the screed, for maintaining the level of paving material at the extremities of the screed. The sensing paddles, for sensing the height of the upper surface of the paving material, however, are fixed to the paving equipment. If the screed width is reduced, it is apparent that the end plates thereof may effect the burying of the sensing paddle in the paving material, by forcing paving material inwardly from the outer ends of the screed.

Paddle controlled potentiometers, directly contacting the hot asphalt, were employed primarily in view of the extremely adverse conditions for the sensing of the height of the top level of the asphalt. Thus, any sensing arrangement must be capable of functioning properly under conditions of extreme temperature variation, as well as being resistant to abrasion and shock. It has further been heretofor considered necessary that the sensing arrangement not be sensitive to local conditions other than the height of the material. The fact that the sensing devices are employed on road making equipment thereby necessitates that they be extremely rugged. In the past it has been considered that, even though many other sensing arrangements may be useful for other applications, paddle controlled potentiometers of the type disclosed in U.S. Pat. No. 3,678,817 provided the only satisfactory solution in paving equipment. As above discussed, however, the provision of paddles physically contacting the asphalt, generally in regions adjacent the ends of the augers, does not provide an optimum solution to the problem.

The present invention is therefore directed to the provision of an improved sensing arrangement for bulk material conveying equipment, especially road equipment such as pavers, which overcomes the above discussed problems of prior arrangements.

Briefly stated, in accordance with the invention, a sensing arrangement is provided for bulk material conveying equipment such as pavers or the like, wherein the sensing arrangement comprises a non-contacting sensor fixedly mounted to the equipment, for sensing the distance between the level of the bulk material and the sensor. The remote location of the sensing device from the bulk material, such as hot asphalt in a paving machine, reduces the requirements of the sensing device to withstand extreme environmental conditions, the sensing device thus no longer being subject to the heat of the asphalt or to abrasion from the material. The provision of the remote sensing device in accordance with the invention further prevents the outputting of erroneous control signals due, for example, to buildup of the material on the sensor, or to actual burying of the sensing device within the material. Contrary to previous belief, it has now been found that non-contacting sensing arrangements not only overcome the above discussed disadvantages of prior arrangements, but also provide satisfactory performance under the extremely harsh environmental conditions as required.

While it has been found that ultrasonic sensing arrangements are especially useful in accordance with the invention, in particular for road paving equipment, the invention also contemplates other remote sensing arrangements of known types, for example, employing light or other radiation to determine the distance between the sensor and the paving material, for example by triangulation. The invention thereby enables the more accurate automatic control of material height, and is especially useful in equipment such as paving machines wherein control of this parameter is essential in the use of the equipment.

In order that the invention may be more clearly understood, it will now be disclosed in greater detail with reference to the accompanying drawings, wherein.

Figure 1:
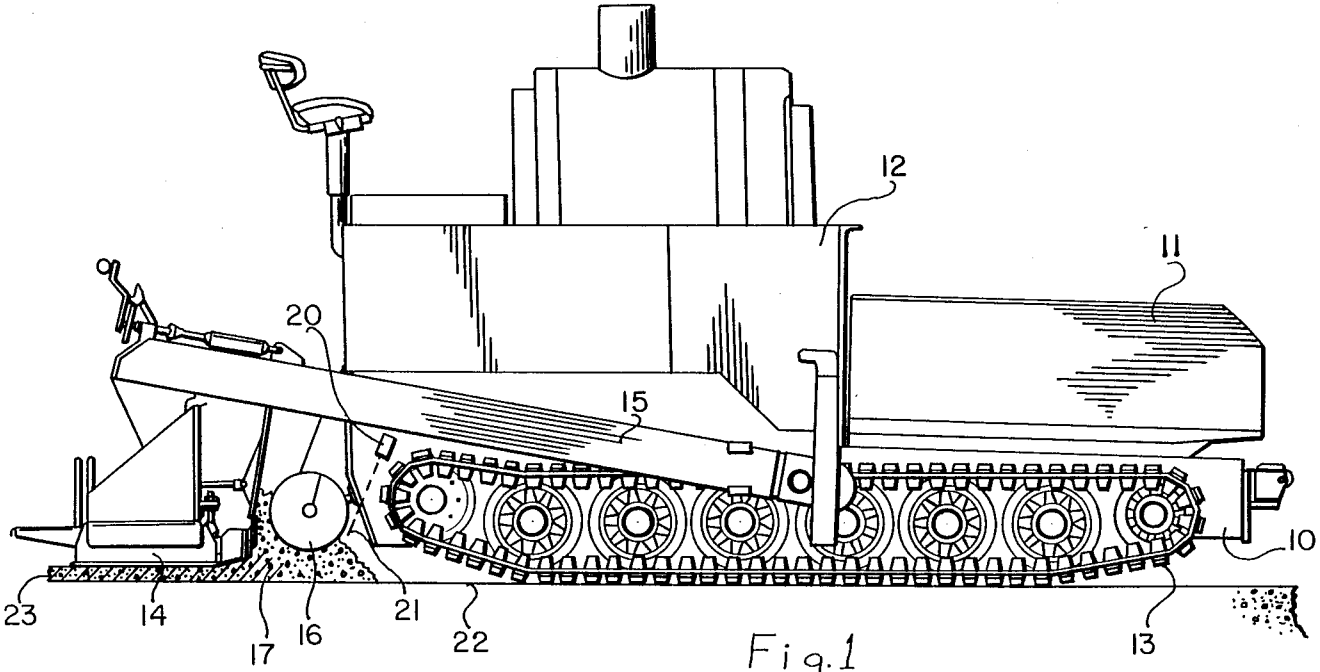
FIG. 1 is a simplified side view of a paving machine incorporating the invention, the paving machine being illustrated partially in section.

FIG. 1 illustrates a paving machine having a frame 10 with a hopper 11 for receiving paving material and a body 12 mounted thereon. The paving machine is adapted to move on endless tracks 13 although it is apparent that it may alternatively be mounted to move on wheels (not shown). A screed 14 is supported pivotally rearwardly of the frame by a screed arm 15. Paving material deposited in the hopper 11 is conveyed by a conveyor (not illustrated) in FIG. 1, to a transversely extending auger 16 in front of the screed, the paving material 17 being transversely distributed by the auger 16 for compaction in a layer of even thickness by the screed 14. The paving machine illustrated in FIG. 1 may thus be, for example, a device of the type disclosed in U.S. Pat. No. 3,700,288.

In accordance with the invention, a sensor, for example, an ultrasonic sensor 20 is mounted to the paving machine, or screed, and directed in the direction of arrow 21 to sense the top surface of the paving material 17. The sensor 21, which may be comprised of an ultrasonic transducer as will be disclosed in greater detail in the following paragraphs, may be rigidly affixed to the paving machine, and preferably separate such transducers are provided at each side of the paving machine to sense the height of the top surface of the paving material adjacent each end of the auger 16. While the drawing illustrates the sensing of the height of the paving material immediately to the front of the auger, it will be apparent that the transducer may be directed to sense the height of the top surface of the paving material at any other convenient location.

The transducer 20 is connected to provide an output signal corresponding to the time of travel of sound waves between the transducer and the top surface of the paving material, this distance hence constituting a measure of the distance between the transducer and the surface 22 upon which the paving machine is driven, and, hence, the thickness of the paving material in front of the screed. FIG. 1 thus illustrates generally the sensing arrangement in accordance with the invention, and its relationship to the paving machine in general. The paving material piled in front of the screed directs forces onto the screed in known manner, whereby the angular orientation of the screed, and hence the thickness of the compacted layer 23 behind the screed, may vary as a function of the amount of material in front of the screed.

Figure 2:
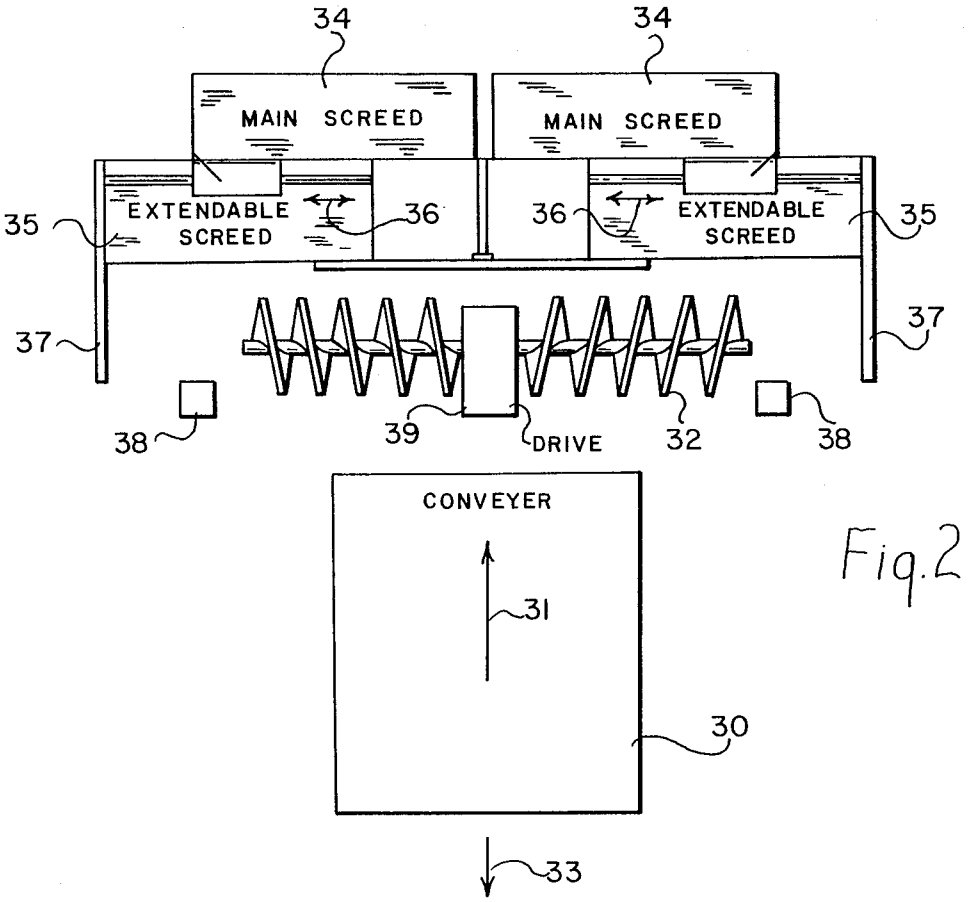
FIG. 2 is a simplified top view of a portion of a paving machine with extendable screeds, illustrating the adaptation of the sensing arrangement of the invention to such a device.

FIG. 2 illustrates a simplified top view of a portion of a paving machine having a telescoping screed, for example, of the type disclosed in U.S. Pat. No. 4,379,653. In this arrangement the paving material is conveyed on a conveyor 30, in the direction of arrow 31, to a rotatable auger 32 extending transversely of the direction of movement (arrow 33) of the paving machine. The paving machine is provided with a pair of fixed main screeds 34 rearwardly of the auger, and a pair of laterally movable screeds 35 in front of the main screeds, the extendable screeds being movable in the directions of the arrows 36. End plates 37 are affixed to the lateral extremities of the extendable screeds. In this arrangement, the non-contacting sensors or transducers 38 in accordance with the invention are mounted above and to the front of the ends of the auger 32, to detect the height of the paving material in this region. The control signals obtained from the sensing devices are employed to control the speed of rotation of the drive 39 of the auger and/or the speed of movement of the conveyor 30 and/or the height of a gate for passing material along the hopper as disclosed, for example, in U.S. Pat. No. 3,678,817.

It is apparent that if the non-contacting sensors of the invention had been replaced by paving material contacting paddles, as in the prior art, inward movement of the end plates 37 would force the paving material inwardly against the sensing paddles, to effect the burial of the paddles within the paving material. The provision of the non-contacting transducer 38 of the invention, above the paving material, eliminates this problem. FIG. 2 thus illustrates further, in a simplified manner, the application of the non-contacting sensors or transducers of the invention to a paving machine.

Figure 3:
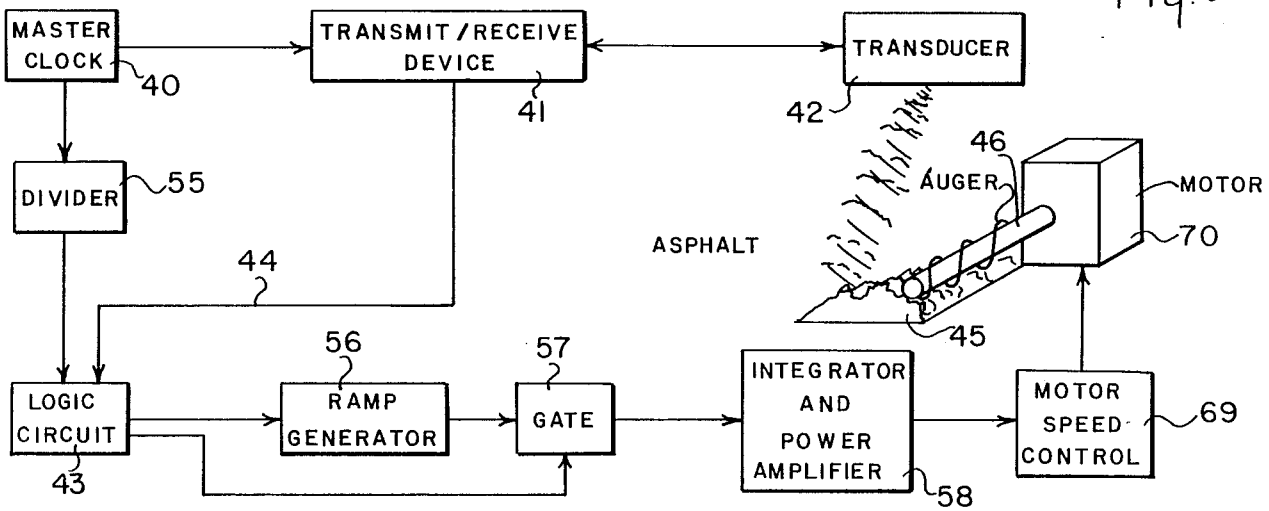
FIG. 3 is a simplified block diagram of a sensing arrangement in accordance with one embodiment of the invention, for application to a paving machine.
Figure 4:
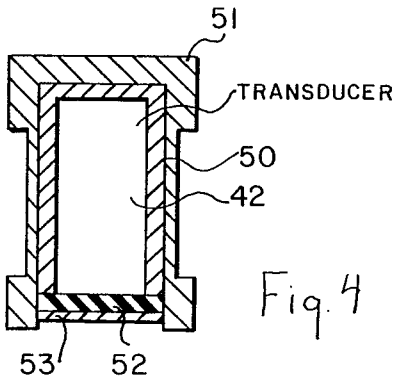
FIG. 4 is a simplified cross sectional view of a sensing head that may be employed in the arrangement of FIG. 3 as well as in the arrangement of FIG. 6.

FIG. 3 is a simplified block diagram of one embodiment of a feed control arrangement of the invention, especially adapted for a paving machine or the like. As illustrated in FIG. 3, a master clock 40 applies timing signals to a transmit/receive device 41 coupled to a transducer 42. The transducer may be an ultrasonic transducer. The transmit/receive device 41 hence comprises a circuit responsive to the control signals from the master clock for energizing the transducer to transmit an ultrasonic pulse. The transmit/receive device also receives echo signals responsive to the receipt of ultrasonic echoes by the transducer 42, for applying an echo responsive signal to a logic circuit 43 by way of a control line 44. The ultrasonic pulses are directed to the paving material such as asphalt 45 forwardly of the auger 46 of the paving machine, so that the elapsed time between the pulse transmitted by the transducer 42 and the ultrasonic echo pulse received by the transducer 42 is a function of the distance between the transducer 42 and the top surface of the asphalt. The transducer 42 is adapted to be fixedly mounted to the paving machine, or screed, so that this time delay is also a measure of the height of the top surface of the asphalt, and hence of the thickness of the asphalt layer.

In order to enable the mounting of the transducer 42 in a rugged manner, the transducer 42 may be a commercially available ultrasonic transducer fixedly mounted in an open-ended plastic housing 50 for installation and support, the plastic housing 50 being fixedly mounted in an aluminum housing 51 for mechanical strength, the housing 51 being shaped as desired to enable its ready mounting to the paving machine. The open end of the plastic housing 50 is covered with a layer 52 of acoustically transparent foam, protected by an external layer 53 of screen wire. The transducer 42 may be Electrostatic Transducer no. 604142 manufactured by the Polaroid Corporation.

Referring again to FIG. 3, the output of the master clock 40 is also applied to a divider or counter circuit 55 for producing a plurality of timing signals for the logic circuits 43. The logic circuit, upon receipt of a signal either from the divider 55 or the transmit/receive device 41, signalling the energization of the transducer, provides a control circuit for a ramp generator 56 to initiate a ramp signal. The time of the initiation of the ramp signal, with respect to the time of the transmit pulse, may be controlled in order that the interval during which the ramp signal occurs, correspond to a determined range of thicknesses of the asphalt. Upon the receipt of the echo signal, the logic circuit opens a gate 57 to pass the instantaneous amplitude of the ramp signal to an integrater and power amplifier 58. The logic circuit 43 further controls the suppression of the ramp signal when no echo is received within a predetermined range of interest. Depending upon the timing employed in the logic circuit, the echo signal may occur prior to the initiation of the ramp, in which case a zero or low level signal is applied to the integrater. The ramp generator may have a maximum ramp level, attained after a given time following its energization, so that this maximum level is passed to the integrater in response to the receipt of an echo signal after the attaining of its full level by the ramp generator.

Figure 5:
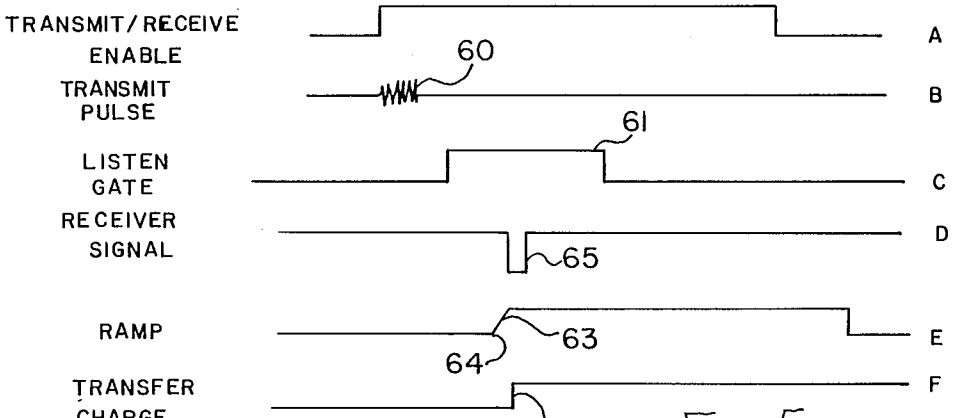
FIG. 5 illustrates various timing signals for the circuit of FIG. 3.

This operation is illustrated in the timing diagrams of FIG. 5, wherein line A illustrates an enable signal from the master clock to the transmit/receive device 41 controlling the device 41 to transmit the ultrasonic pulse 60 as illustrated on line B. The logic circuit may develop a listen gate 61, as illustrated in line C, during which time the logic circuit 43 is responsive to the receipt of echo pulses from the device 41, as illustrated on line E, the time 64 being a predetermined time following the initiation of the transmit pulse 60.

Upon receipt of the echo signal 65, as illustrated on line D, the generation of the aforementioned ramp signal 63 ceases as shown on line E, and the gate 57 is opened by the logic circuit 43, as illustrated by the rise at 66 of line F, to pass the then occurring signal level of the ramp to the integrater and power amplifier 58.

The integrater and power amplifier 58 integrates the received signal over a number of cycles, for example, about 10 pulses of ultrasonic energy, in order to avoid erroneous output signals resulting from such conditions, for example, as uneven surfaces of the asphalt or vibration of the transducer. The intermediate signals are amplified and applied to a motor speed control device 69 for controlling the auger motor 70. The motor speed control 69 may conventionally constitute a torque motor on a servo valve, for controlling the speed of rotation of the motor 70, when an hydraulic motor is employed.

In the arrangement of the invention as illustrated in FIGS. 3 and 5, the ramp 63 is positioned in the timing diagram to occur when the top of the sensed asphalt is within a determined range of distances from the transducer in which variable speed control of the auger motor is to be effected. This range may be, for example, about 2 inches. Thus, if an echo signal is received before the initiation of the ramp, indicating that the top of the asphalt is too close to the transducer, the level on line E before the initiation of the ramp is passed to the integrater, indicating that further material should not be fed by the auger. If the echo signal is received at the time or after the maximum level of the ramp, indicating that the level of asphalt is below the 2 inch control range thereof, the maximum signal level is passed to the integrater, and the motor speed control 69 controls the motor to its fastest speed rate. The motor speed control 69 may, of course, additionally be employed to control the feed of material by way of the conveyor. When the height of the top of the asphalt falls in the two inch range as determined by the positioning of the ramp 63, the signal passed to the integrater is intermediate its maximum and minimum levels, thereby enabling the variable speed control of the motor 70 by the motor speed control device 69.

Figure 6:
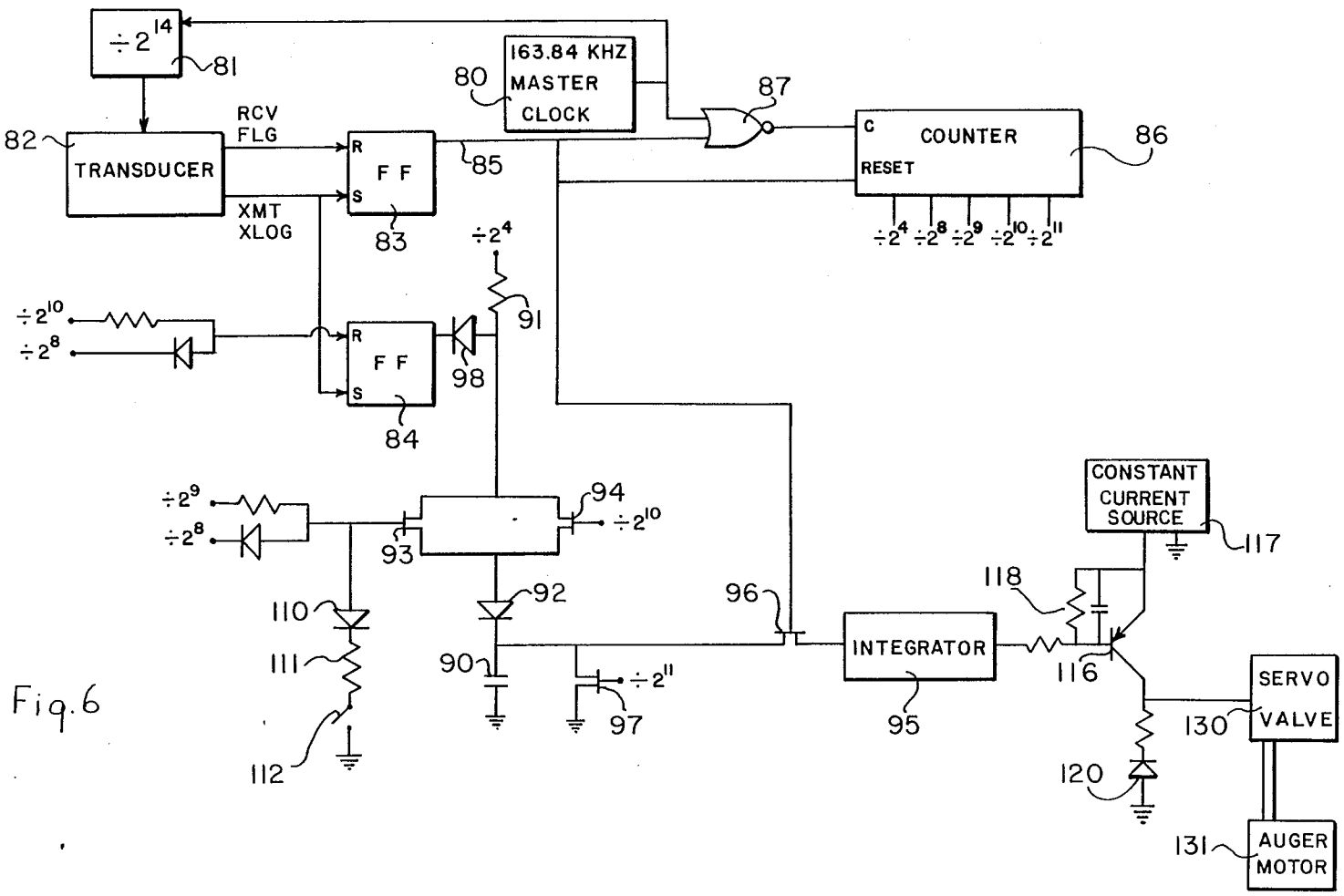
FIG. 6 is a more detailed circuit of a preferred embodiment of the invention.
Figure 7:
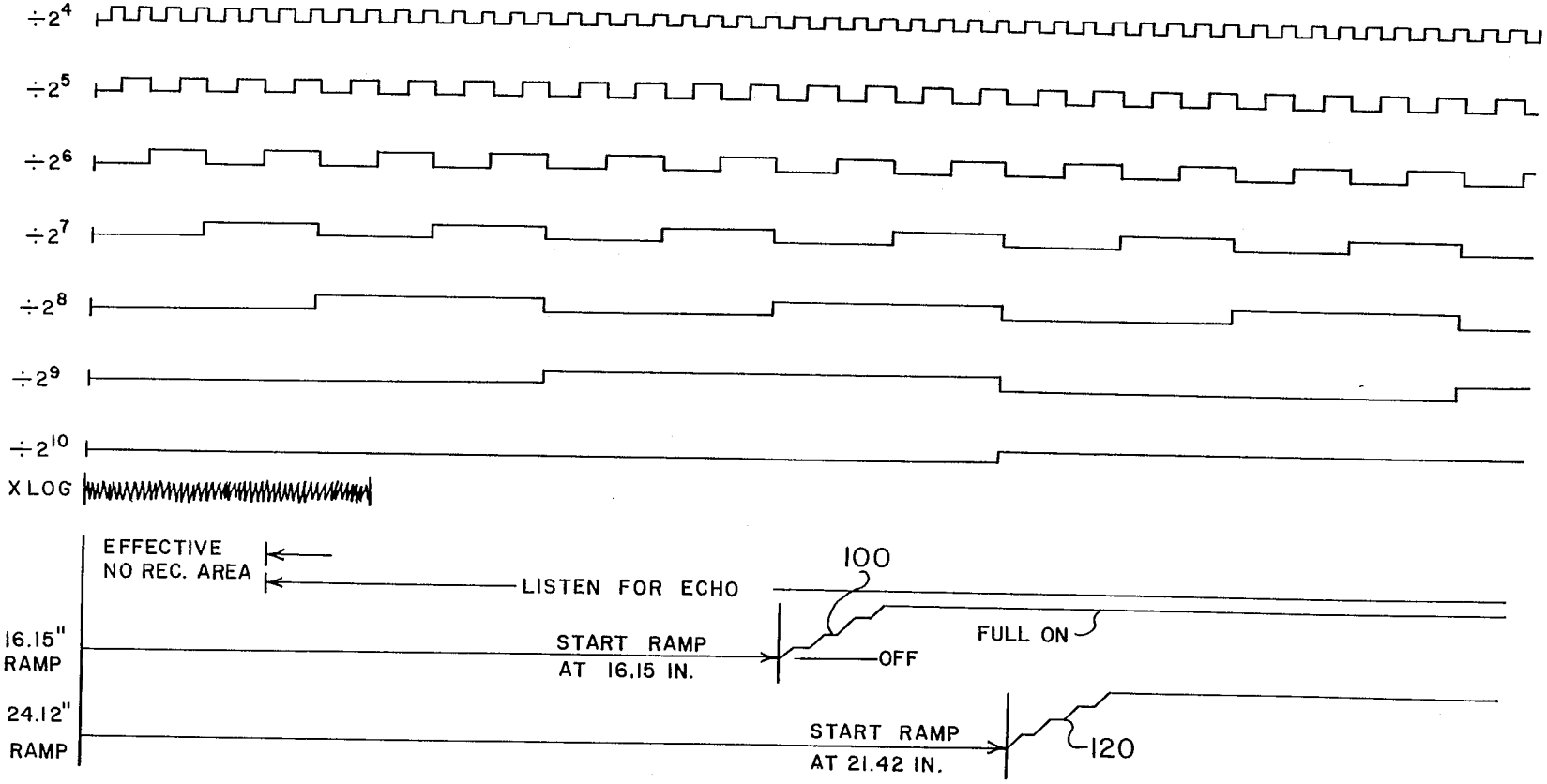
FIG. 7 illustrates various timing wave forms of the circuit of FIG. 6.

FIG. 6 illustrates a more detailed circuit diagram of a circuit in accordance with the invention, operative with a determined commercially available ultrasonic ranging system, for controlling the feed of the bulk material such as asphalt. FIG. 7 illustrates the timing employed in various portions of the circuit of FIG. 6.

As illustrated in FIG. 6, a master clock 80 of conventional design, having a clock frequency, for example, of 163.84 kilohertz, has an output divided by the divider 81 to produce an approximately 10 Hz cycle squarewave for the control of the transducer system 82. The transducer system 82 is comprised of an Electrostatic Transducer No. 604142 produced by the Polaroid corporation, and a ranging board No. 607089, also of the Polaroid corporation. This system is responsive to the control squarewave from divider 81 to emit a transmit pulse shortly after the leading edge of the control signal. The transmit pulse is about one millisecond long and consists of about 56 cycles of 49.41 KHz. The start of this transmit signal is not accurately spaced from the energizing signal applied thereto from the divider 81. The XLOG output of the transducer circuit is an active low signal starting at the beginning of the transmit pulse and ending at the end of the transmit pulse. The transducer 82 further outputs a receive flag FLG which is an active low signal responsive to the receipt of an echo by the transducer.

As illustrated in FIG. 6, the transmit and receive outputs of the transducer 82 are applied to the set and reset inputs respectively of a flip flop 83, and the transmit pulse is also applied to the set input of a flip flop 84. The output 85 of the flip flop 83 is set low by the transmit pulse, to enable the application of clock pulses to the counter 86 by way of the NOR gate 87, whereby the counter 86 starts counting at the start of the transmit pulse from the transducer circuit 82. This arrangement enables sychronization of the counter circuit with the transducer, in view of the instability of the start of the transmit pulse from the transducer.

The counter 86 has a plurality of outputs as illustrated, corresponding to divisions by the 4th, 8th, 9th, 10th and 11th powers of two. These outputs are employed to control the timing in the remainder of the circuits. The relative relationships of the divide by 4th power of two to the divide by the 10th power of two are illustrated in the first seven lines of the timing diagrams of FIG. 7. The XLOG transmit pulse is indicated on the 8th line of FIG. 7.

The ramp generator of the arrangement in FIG. 6 includes a charging capacitor 90 serially connected with a charging resistor 91 by way of a charging diode 92 and the parallel source-drain paths of transistors 93 and 94. The voltage across the charging capacitor 90 is applied to an integrator circuit 95 by way of the source-drain path of transistor 96, and the capacitor 90 is shunted to ground by way of the source-drain path of transistor 97.

In order to more fully understand the operation of the circuit of FIG. 6, it will initially be explained that it is desirable to be able to receive an echo pulse, in one embodiment of the invention, in the range of spacings from 4 inches to 42 inches from the transducer, and not to receive echoes from targets outside of this range. It is further desirable to control the auger so that it does not feed asphalt when the detected top surface of the asphalt is closer than about 16.15 inches from the transducer, to control the auger at its full speed when the distance between the top of the asphalt and the transducer is about 18.15 inches or greater, and to have proportionately intermediate speeds for detected levels of the top of the asphalt within this range of about 2 inches. The voltage across the capacitor 90, which is passed to the integrater 95, then must be zero if an echo signal occurs indicating a distance less than 16.15 inches, and must have a maximum value at the time corresponding to a distance of about 18.15 inches or greater. Accordingly, the charging resistor 91 and the capacitor 90 are selected to have an RC value permitting this charging rate.

Referring again to FIG. 6, the receive output of the transducer 82 is normally high, and goes low upon the receipt of an echo signal, to reset the flip flop 83. The resultant high level at the output 85 of the flip flop 83 blocks the NOR gate 87 to stop counting in the counter, resets the counter, and renders the transistor 96 conductive to pass the charge of the charging capacitor 90 to the integrator 95.

The generation of a ramp is controlled by the transistor 93, which, as indicated, occurs in response to positive levels of the divide by the 8th and 9th powers of two of the clock signal. As apparent in FIG. 7, the second occurrence of this coincidence occurs at a time corresponding to a spacing of 16.15 inches, and hence the transistor 93 is rendered conductive at this time to enable the charging of the capacitor 90. The flip flop 84 is employed in order to block charging of the capacitor at the first occurrence of this coincidence, and during the transmit pulse, by holding the capacitor at low level by way of the diode 98 at the output of the flip flop 84. Thus, the capacitor voltage 90 cannot rise from the time that the flip flop 84 is set by the transmit pulse, until the time that the divide by the eighth power of two signal goes low when the divide by 2 to the 10th power signal is low (at about 1.6 milliseconds from the start of the transmit pulse).

The minimum time at which the system can respond to a receive or echo pulse is determined by the transducer itself, and corresponds to about 0.6 milliseconds (about 4 to 5 inches). An echo pulse received anytime subsequent to this time results in the resetting of the flip flop 83, the stopping of the counter, the resetting of the counter and the passing of the charge on the capacitor 90 to the integrator 95 as discussed.

As above discussed, the capacitor is charged to substantially its full charging value in a time period corresponding to about 2 inches of space.

While, in accordance with the invention, the ramp may constitute a continuous charging of the capacitor 90, it is preferred that the capacitor be charged in steps, to have a plateau intermediate the steps, as illustrated by the ramp 100 in the 9th line of FIG. 7. Thus, as illustrated in FIG. 6, the charging voltage of the capacitor is the divide by the 4th power of two output of the counter. This results in the charging of the capacitor in about 4 steps, each corresponding to about one quarter of the full height of the ramp.

In a preferred embodiment of the invention, it is desirable to be able to readily change the time of initiation of the ramp, in order to enable either control of the top of the asphalt at a different level, or its simple application of the transducer to different types of equipment. For this purpose, the gate of the transistor 93 is held low by way of the diode 110 and resistor 111 by the closing of a selection switch 112. The gate of the transistor 94 is energized by the divide by the 10th power of two output of the counter, whereby the transistor 94 is rendered conductive initially at a time corresponding to a spacing from the transducer of 21.42 inches, providing the ramp 120, as illustrated in the last line of FIG. 7.

The integrater 95 is comprised of a conventional integrated circuit having circuit components enabling the integration of input signals for a period of about 1 second, corresponding to about 10 cycles of the ultrasonic system. The output of the integrater 95 is applied to a transistor power amplifier 116 supplied by a constant current source 117 of conventional construction. The transistor amplifier 116 is provided with a parallel RC feedback network 118 to provide fast response-slow decay characteristics, and a diode 120 may be connected in series with the collector resistor for spiked protection. The output of the amplifier 116 is directed to the servo valve 130, of conventional construction, for control of the auger motor 131.

The devices employed in the circuit of FIG. 6 are conventional, and it may be conventional CMOS devices. The transistors employed in the timing control circuitry may constitute conventional transmission gates, and the counter 86 and divider 81 are conventional CMOS devices.

The capacitor 90 is discharged every cycle of the ultrasonic pulse, when no echo is received within a range of interest, by the divide by the 11th power of 2 signal, by the transistor 97.

While it is preferred that the transducer be an ultrasonic transducer for applications where high heat can be expected in the material to be distributed, such as asphalt paving materials, it is apparent that the concept of the invention is also applicable to other transducer devices, such as piezo electric devices. Further, in accordance with the invention, it is apparent that other distance measuring arrangements may be employed, such as triangulation devices employing various forms of radiation. It is still further apparent that means are preferably provided for overriding the automatic control of the invention for manual operation, in the event that automatic control is not desired. This may be effected by conventional devices, for example, upon the disablement of the circuit of the invention. It is of course further apparent that the output of the circuit can be employed, instead of or in addition to automatically controlling the auger and/or conveyor feed, to control an indicator, whereby an operator may view such indicator to effect the manual control of the feed.

An electronic transducer of the above disclosed type provides the advantage of substantial immunity to external influences, since the transducer is directional. The immunity is increased by inhibiting any response to signals received from distances greater that about 40 inches. The device is hence substantially immune to control by humps or ridges in the surface being paved, material spilled from the truck or hopper, or material pulled in by narrowing of the paving width. The transducer may be mounted at a location where it does not interfere with installation or removal of components of the paving machine. The circuit of the invention is also readily adaptable to automatic or remote control of material feed.

It is a further advantageous feature of the invention that the auger or other feed device controlled by the system is turned off when the first echo received corresponds to a distance of about 16 inches or less, corresponding to an over supply of asphalt. This feature thereby renders the system operative to shut off the auger in the event of other objects between the auger and the transducer, and can prevent injury to operating personnel if they are intentionally or accidentally present in this space, by effecting the turning off of the auger.

While the invention has been disclosed and described with reference to a limited number of embodiments, it is apparent that variations and modifications may be made therein, and it is therefore intended in the following claims to cover each such variation and modification as follows within the spirit and scope of the invention.

I claim:—

1. In a paving material conveying equipment having a first conveying device for distributing a paving material in a first direction on a surface to be paved, a second conveying device for conveying said paving material in a second direction to said first conveying device, sensing means for sensing the height of said paving material distributed by said first conveying device onto said surface to be paved, at a given position, for producing a control signal, and means responsive to said control signal for controlling the quantity of paving material distributed by said first conveying device to said given position for maintaining said height substantially constant; the improvement wherein said sensing means comprises non-contacting sensing means fixedly mounted on said equipment spaced from said paving material at a predetermined height above said surface to be paved for producing said control signal, whereby said control signal is a function of the distance between said non-contacting sensing means and an upper surface of said paving material at said given position.

2. The paving material conveying equipment of claim 1 wherein said first direction is a horizontal direction, said second direction is a horizontal direction transverse to said first direction, and said non-contacting sensing means comprises means for transmitting a beam of radiation to and receiving radiation reflected from said upper surface and control means including means responsive to received radiation for producing said control signal.

3. The paving material conveying equipment of claim 2 wherein said means for transmitting and receiving comprises an ultrasonic transducer.

4. The paving material conveying equipment of claim 3 wherein said equipment comprises a paving device adapted to be movable along a first surface in the direction opposite said second direction for distributing and compacting paving material on said first surface, said first conveying device comprises a horizontal rotatable auger, said paving device further having a floating screed mounted rearwardly of said auger, and said transducer is mounted on said paving device, said given position being forwardly of said auger at the axial outer extremity thereof.

5. The paving material conveying equipment of claim 4 wherein said control means further comprises a source of clock pulses, means responsive to said clock pulses for periodically controlling said sensing means to transmit a pulse of ultrasound, counter means coupled to said source of clock pulses for the generation of a sequence of timing signals, first gate means responsive to the transmission of a pulse of ultrasound by said sensing means for enabling said counter means to count clock pulses and responsive to reception of a subsequent echo pulse for stopping and resetting said counter means, ramp generator means responsive to said timing signals of said counter means for initiating the production of a ramp signal of an amplitude that is a function of the distance between said transducer and paving material at said given position, and means responsive to said ramp signal for producing said control signal.

6. The paving material conveying equipment of claim 5 wherein said means responsive to said ramp signal comprises integrating means, and second gate means responsive to the reception of an echo signal for applying said ramp signal to said integrating means.

7. The paving material conveying equipment of claim 5 further comprising means responsive to the absence of reception of echo signal within a given time following the transmission of an ultrasound pulse for resetting said counter means

8. The paving material conveying equipment of claim 5 wherein said ramp generator means comprises a capacitor, and means charging said capacitor with a first determined output of said counter, and said control means further comprises means responsive to a second determined output of said counter means for periodically discharging said capacitor.

9. The paving material conveying equipment of claim 8 wherein said control means comprises means responsive to further outputs of said counter means for inhibiting charging of said capacitor for a determined time during and following the transmission of an ultrasound pulse.

10. The paving material conveying equipment of claim 9 wherein said control means further comprises means for selectively varying said determined time during which said capacitor is inhibited from charging.

11. In a road paving equipment movable along a first surface on which paving material is to be deposited and compacted, and comprising an auger for distributing paving material in a first direction transverse of the direction of movement of the equipment, a conveying device for conveying said paving material to said auger in a direction opposite said direction of movement, a screed mounted rearwardly of said auger, sensing means mounted on said equipment for producing a control signal that is a function of the height of said paving material at a given position adjacent said auger, and means responsive to said control signal for controlling the distribution of said paving material to said given position for maintaining said height substantially constant; the improvement wherein said sensing means comprises non-contacting sensing means fixedly mounted on said equipment spaced from said paving material at said given position for producing said control signal, whereby said control signal is a function of the distance between said non-contacting sensing means and an upper surface of said paving material at said given position.

12. The road paving equipment of claim 11 wherein said sensing means comprises a control circuit, means for periodically producing a ramp signal having a duration that is a function of said distance, an integrating circuit means for producing said control signal, and gate means for passing the instantaneous level of said ramp signal to said integrating circuit in response to the sensing by said sensing means of said paving material.

13. The road paving equipment of claim 12 wherein said sensing means further comprises an ultrasonic transducer for transmitting ultrasonic pulses and receiving ultrasonic echoes, said control circuit further comprising timing circuit means for periodically energizing said transducer to transmit ultrasonic pulses, said timing circuit means further comprising means initiating the generation of a ramp signal a first determined time following the transmission of an ultrasonic pulse, means for stopping the generation of said ramp signal at a second predetermined time following said first time, and means for suppressing said ramp signal at a third predetermined time following its generation.

14. The road paving equipment of claim 13 wherein said timing circuit means further comprises means for adjusting the time of occurrence of said second predetermined time.

15. A control circuit for producing a control signal in response to the output of an ultrasonic transducer wherein the transducer is responsive to an input signal for transmitting an ultrasonic pulse and is responsive to an ultrasonic echo for outputting an echo signal, said control circuit comprising a timing circuit having a first output for periodically controlling said transducer to transmit ultrasonic pulses at a first predetermined time, a ramp signal generation circuit for generating a ramp signal, an integration circuit for producing said control signal, a first gate for passing the instantaneous amplitude of said ramp signal to said integration circuit, and means responsive to said echo signal for energizing said first gate circuit to pass the amplitude of said ramp signal to said integration circuit, said timing circuit further comprising means initiating the generation of said ramp signal at a second predetermined time following said first predetermined time, means stopping the generation of said ramp signal at a third predetermined time following said second predetermined time, and means for suppressing said ramp signal at a fourth predetermined time following said second predetermined time.

16. The control circuit of claim 15 wherein said timing circuit comprises a clock signal generator and a counter, said counter having a plurality of outputs corresponding to different divisions of the clock signal, and said ramp generator comprises a capacitor and a charging circuit for the capacitor, said means suppressing said ramp signal comprising means responsive to a given output of said counter for discharging said capacitor.

17. The control circuit of claim 16 wherein said control circuit further comprises flip flop means responsive to the transmission of ultrasonic pulses for enabling said counter to count and responsive to the reception of an echo pulse for resetting said counter and enabling said first gate circuit to pass the amplitude of said ramp signal to said integration circuit.

18. The control circuit of claim 16 wherein said timing circuit further comprises second gate circuit responsive to determined outputs of said counter for enabling the charging of said capacitor at said second predetermined time.

19. The control circuit of claim 18 further comprising switch means enabling the control of the outputs of said counter which are employed to determine said second predetermined time.

20. The control circuit of claim 16 wherein a determined output of said counter is employed to charge said capacitor, whereby said capacitor is stepwise charged.

* * * * *